US011654649B2

(12) United States Patent
Chen

(10) Patent No.: US 11,654,649 B2
(45) Date of Patent: May 23, 2023

(54) PAPER TUBE MAKING APPARATUS

(71) Applicant: CHAN LI MACHINERY CO., LTD., Taoyuan (TW)

(72) Inventor: Ting Chao Chen, Taichung (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 0 days.

(21) Appl. No.: 17/206,639

(22) Filed: Mar. 19, 2021

(65) Prior Publication Data

US 2021/0316524 A1 Oct. 14, 2021

(51) Int. Cl.
*B31C 3/04* (2006.01)

(52) U.S. Cl.
CPC ..... *B31C 3/04* (2013.01)

(58) Field of Classification Search
CPC ..... B31C 3/04; B31D 5/0095; A47G 21/18
See application file for complete search history.

(56) References Cited

U.S. PATENT DOCUMENTS 4,378,966 A 4/1983 Schumacher
5,468,207 A * 11/1995 Bower ..... B29C 53/8083 493/271
5,586,963 A * 12/1996 Lennon ..... B31C 3/04 156/425
6,350,500 B1 * 2/2002 Drummond ..... B65D 3/22 229/203
6,378,763 B1 * 4/2002 Nelson ..... B31C 3/00 229/162.5
6,539,999 B2 * 4/2003 Polzin ..... B29C 66/1122 156/499
7,452,318 B2 * 11/2008 Gelli ..... B31C 3/00 493/299
7,922,641 B2 * 4/2011 Maddaleni ..... B31C 11/00 493/298

FOREIGN PATENT DOCUMENTS

JP 2001353796 A 12/2001
JP 2003340944 A 12/2003

OTHER PUBLICATIONS

Foreign Office Action Issued by Patent Office of Japan for Application 2021065285 dated Feb. 22, 2022.
International Office Action Issued by Foreign Patent Office for Application No. 202010269115.6/2022050502146370 dated May 9, 2022.

* cited by examiner

*Primary Examiner* — Chelsea E Stinson
(74) *Attorney, Agent, or Firm* — Rosenberg, Klein & Lee

(57) ABSTRACT

A paper tube making apparatus includes a fixed rod, a paper tape winding mechanism, a glue applying device, a length measurement unit, and a hot airflow generation unit. The length measurement unit measures a conveying speed of a paper tape, and the glue applying device is operable to coat glue on the paper tape. The hot airflow generation unit is located downstream of the length measurement unit and the glue applying device and is operable to adjust the flow rate and temperature of a hot airflow according to the conveying speed of the paper tape. The hot airflow generation unit blows the hot airflow generated thereby toward the paper tape to control the extent of drying of the glue, so that the extent of drying of glue coated on the paper tape is not affected by the environment temperature and humidity and the quality of the paper tube so fabricated is enhanced.

6 Claims, 4 Drawing Sheets

PAPER TUBE MAKING APPARATUS

BACKGROUND OF THE INVENTION

1. Field of the Invention

The present invention relates to a paper tube making apparatus, which prevents environmental temperature and humidity from affecting extent of drying of glue that is applied to a paper tape.

2. The Related Arts

A paper tube making apparatus is operated by generally applying and coating glue on at least one paper tape that is subsequently wound to form a paper tube. The paper tube is then subject to cutting by a cutter in order to manufacture paper tubes of a predetermined length. The paper tube has various uses. For example, a paper tube may serve as a paper drinking straw. In addition, toilet tissue may be wound around a paper tube to provide a toilet paper roll.

The paper tape is coated glue in order to be bonded together. The glue is susceptible to environmental variations, such as temperature and humidity, and the extent of drying and thus bonding power of the glue are affected. This may lead to deterioration of quality of a paper tube so manufactured. In practical applications, the formulation of the glue must be modified according to the temperature and humidity, and this causes difficulty of manufacturing. Without properly modifying the glue formulation to the best according to the temperature and humidity, the quality of the paper tube would be affected.

To overcome the above-discussed issues of the prior art, the present invention provides a novel paper tube making apparatus, which enhances efficiency of paper tube generation and prevents variations of temperature and humidity from affecting the quality of the paper tube.

SUMMARY OF THE INVENTION

An objective of the present invention is to provide a paper tube making apparatus, which includes a hot airflow generation unit that generates and blows a hot airflow toward at least one paper tape, in order to stabilize the extent of drying of glue coated on the paper tape, and a paper tape winding mechanism that wraps and winds the paper tape around a fixed rod to form a paper tube, so that the quality of the paper tube so formed is enhanced.

An objective of the present invention is to provide a paper tube making apparatus, which includes a length measurement unit arranged an upstream of the paper tape winding mechanism and the fixed rod to measure a conveying speed of the paper tape. The hot airflow generation unit is operable to adjust a flow rate and a temperature of the hot airflow according to the conveying speed of the paper tape, in order to stabilize the extent of drying of glue coated on the paper tape.

An objective of the present invention is to provide a paper tube making apparatus, which controls the extent of drying of the glue coated on the paper tape using the hot airflow generated by the hot airflow generation unit so as to reduce the influence on the extent of drying of the glue by environment temperature or humidity and also to effectively enhance the fabrication quality of the paper tube.

To achieve the above objectives, the present invention provides a paper tube making apparatus, which comprises: a fixed rod; a paper tape winding mechanism, which is arranged adjacent to the fixed rod, wherein the fixed rod and the paper tape winding mechanism receive a paper tape, and the paper tape winding mechanism is operable to wind the paper tape around the fixed rod to form a paper tube; a glue applying device, which is arranged an upstream of the fixed rod and the paper tape winding mechanism and is operable to coat glue on the paper tape; a length measurement unit, which is arranged the upstream of the fixed rod and the paper tape winding mechanism and is operable to measure a conveying speed of the paper tape; and a hot airflow generation unit, which is arranged between the glue applying device and the paper tape winding mechanism to generate a hot airflow, wherein the hot airflow generation unit adjusts a flow rate and a temperature of the hot airflow according to the conveying speed of the paper tape.

The paper tube making apparatus comprises a cutter, which is arranged adjacent to the fixed rod and is operable to cut the paper tube formed on the fixed rod.

The paper tube making apparatus comprises a drive mechanism, which is connected to the cutter and is operable to drive the cutter to move along the fixed rod.

In the paper tube making apparatus, the paper tape winding mechanism comprises a supporting base, a driving roller, at least one pulley, and a belt, the driving roller and the pulley being mounted on the supporting base, the belt being wound around the driving roller, the pulley, and the fixed rod, wherein the paper tape is located between the belt and the fixed rod, such that the driving roller, when rotating, drives the belt to wind the paper tape around the fixed rod to form the paper tube.

The paper tube making apparatus comprises at least one transportation roller, which is arranged the upstream of the fixed rod and the paper tape winding mechanism to convey the paper tape to the fixed rod and the paper tape winding mechanism, the length inspection unit being connected to the transportation roller and being operable to count turns of rotation of the transportation roller in order to determine the conveying speed of the paper tape.

The paper tube making apparatus comprises a calculation unit that is in electrical connection with the length measurement unit and the hot airflow generation unit, and is operable to calculate the conveying speed of the paper tape according to a conveyed length of the paper tape measured by the length measurement unit, and is operable to control the flow rate and the temperature of the hot airflow generated by the hot airflow generation unit according to the conveying speed of the paper tape.

In the paper tube making apparatus, the length measurement unit is arranged the upstream of the glue applying device.

In the paper tube making apparatus, the glue applying device comprises a glue applying roller and a glue tank. The glue tank receives and holds glue. The glue applying roller is arranged in contact with the glue received and held in the glue tank and is operable to coat the glue on the paper tape in contact therewith.

DETAILED DESCRIPTION OF THE PREFERRED EMBODIMENTS

Figure 1:
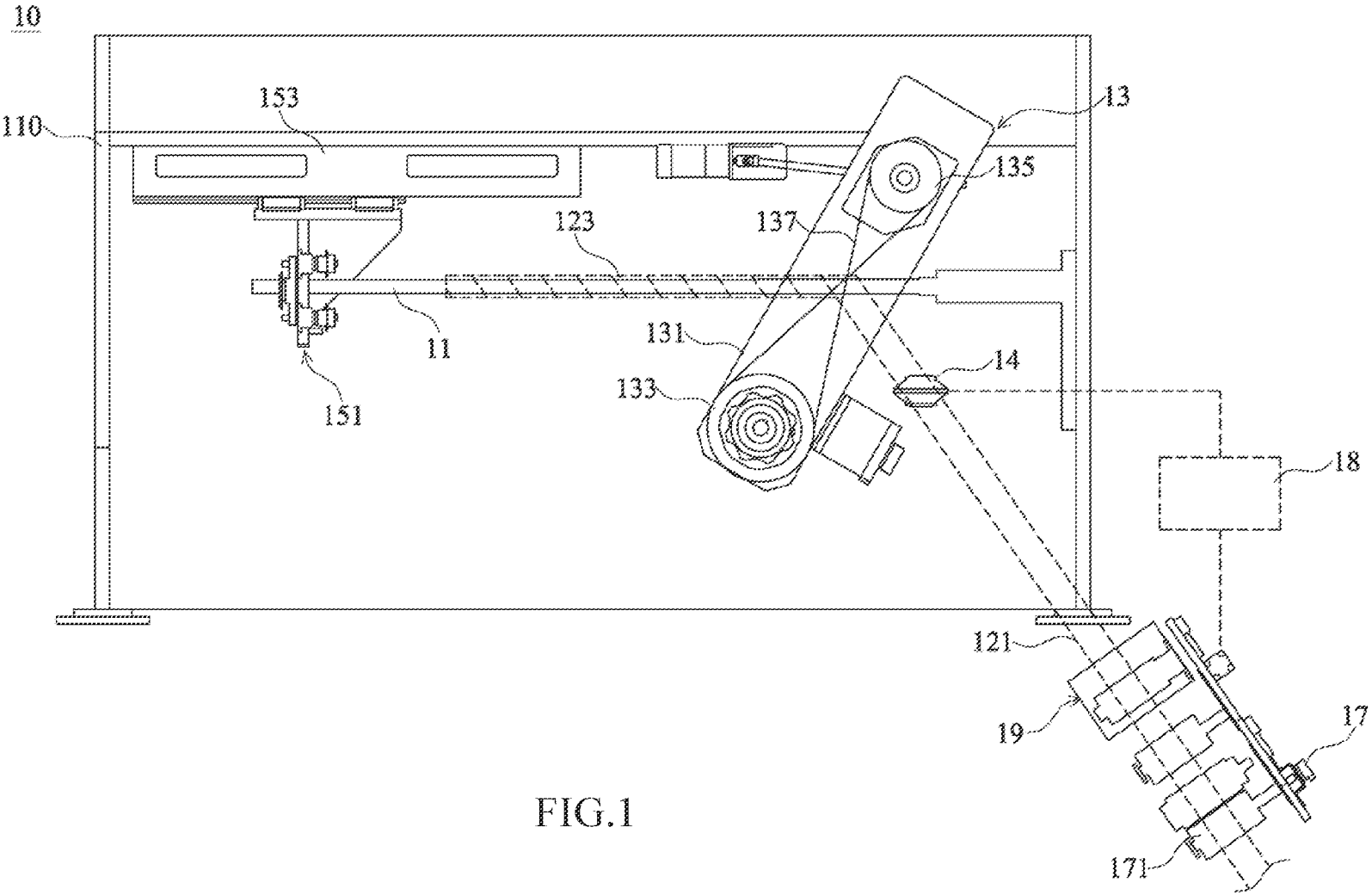
FIG. 1 is a schematic view showing a structure of a paper tube making apparatus according to an embodiment of the present invention.
Figure 2:
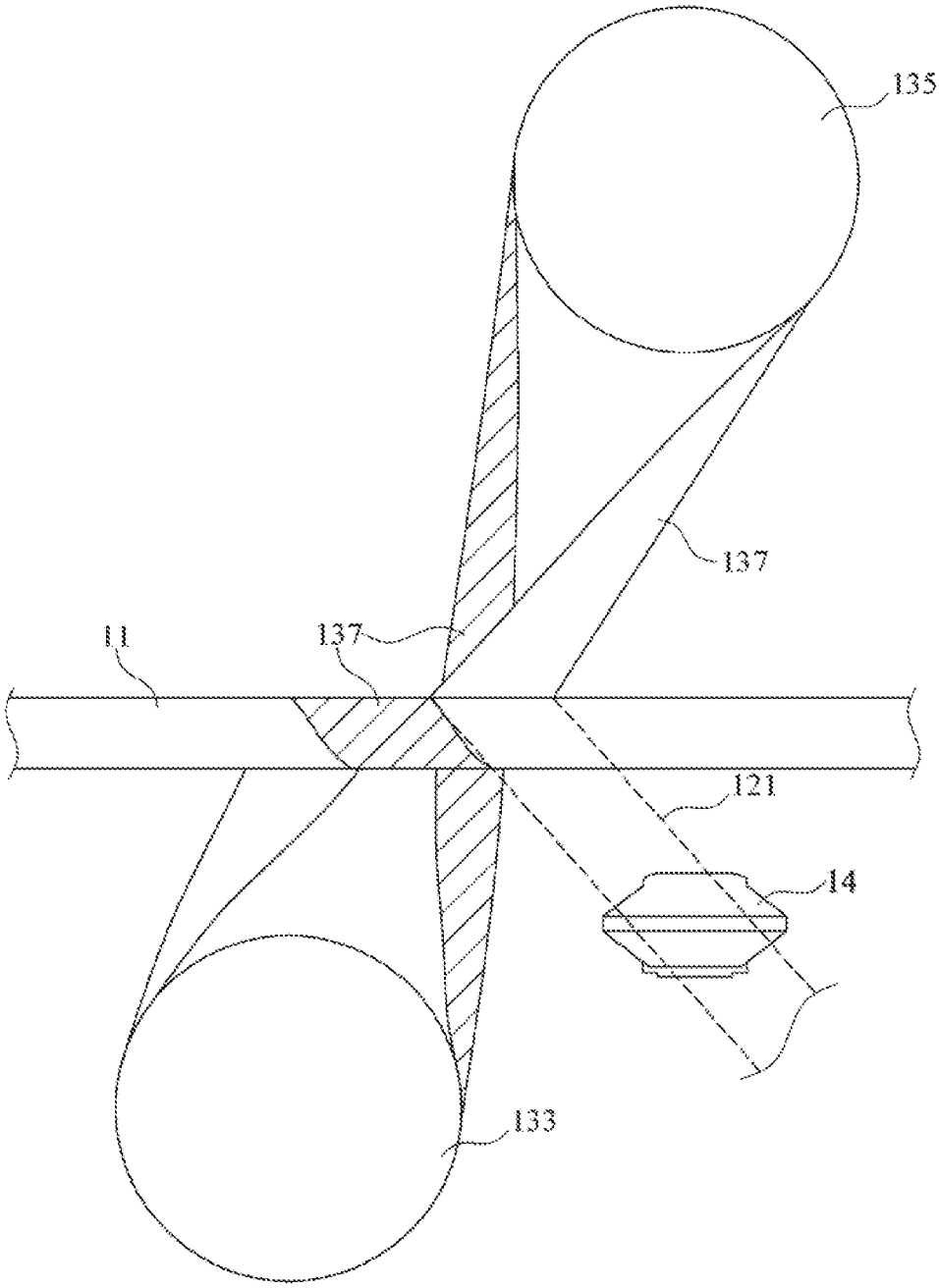
FIG. 2 is a schematic view showing, in an enlarged form, a fixed rod and a paper tape winding mechanism of the paper tube making apparatus according to an embodiment of the present invention.

Referring to FIGS. 1 and 2, which are, respectively, a schematic view showing a structure of a paper tube making apparatus according to an embodiment of the present invention and a schematic view showing, in an enlarged form, a fixed rod and a paper tape winding mechanism. As shown in the drawings, the paper tube making apparatus 10 generally comprises a fixed rod 11, a paper tape winding mechanism 13, a hot airflow generation unit 14, a length measurement unit 17, a glue applying device 19, and a cutter 151. The paper tape winding mechanism 13 and the fixed rod 11 are arranged to receive a paper tape 121, and the paper tape winding mechanism 13 is operable to wrap or wind the paper tape 121 around the fixed rod 11 to form or generate a paper tube 123.

The fixed rod 11 is of a cylindrical form or an elongate bar. The paper tape winding mechanism 13 is arranged adjacent to the fixed rod 11. For example, the fixed rod 11 is arranged as being fixed to a machine frame 110, such that the fixed rod 11 is not rotatable or movable relative to the machine frame 110.

In an embodiment of the present invention, the paper tape winding mechanism 13 comprises a supporting plate 131, a driving roller 133, at least one pulley 135, and a rolling belt 137. The supporting plate 131 can be in the form of an arm plate, and the driving roller 133 and the pulley 135 are mounted on the supporting plate 131 and are rotatable relative to the supporting plate 131. The belt 137 is looped or wound around the driving roller 133 and the pulley 135, such that the driving roller 133, when driven by a motor to rotate, would drive the pulley 135 to rotate by means of the belt 137.

The belt 137 of the paper tape winding mechanism 13 is wound around the fixed rod 11 in the way shown in FIG. 2. For example, the driving roller 133 and the pulley 135 of the paper tape winding mechanism 13 are respectively located below and above the fixed rod 11, and a portion of the belt 137 that is located between the driving roller 133 and the pulley 135 is wound around the fixed rod 11. When the driving roller 133 rotates, the belt 137 is caused to move relative to the fixed rod 11.

In a practical application, at least one paper tape 121 is positioned such that a portion thereof is located in a gap between the fixed rod 11 and the belt 137, and when the driving roller 133 rotates and thus drives the belt 137 to move relative to the fixed rod 11, the belt 137 is caused to wrap or wind the portion of the paper tape 121 located between the fixed rod 11 and the belt 137 around the fixed rod 11 to form a paper tube 123. The paper tube 123, as being generated in this way, continuously extends or elongates along the fixed rod 11 in a direction toward the cutter 151, until the driving roller 133 stops rotation. In the example shown in the drawings, the present invention is embodied by wrapping or winding one single paper tape 121 around the fixed rod 11 to form the paper tube 123; however, in other embodiments, multiple paper tapes 121 may be wound together around the fixed rod 11 to form the paper tube 123.

In an embodiment of the present invention, the supporting plate 131 is mounted to the machine frame 110 in a manner of being swinging or rotating relative to the machine frame 110. When the supporting plate 131 swings relative to the fixed rod 11, an angle at which the belt 137 is wound around the fixed rod 11 is changed so as to vary or adjust a feed-in angle of the paper tape 121 fed onto the fixed rod 11. The above-described specifics or details of the structure of the paper tape winding mechanism 13 are provided to illustrate one embodiment of the present invention and are not intended to impose undue constraint to the scope of protection that the present invention seeks for.

Figure 3:
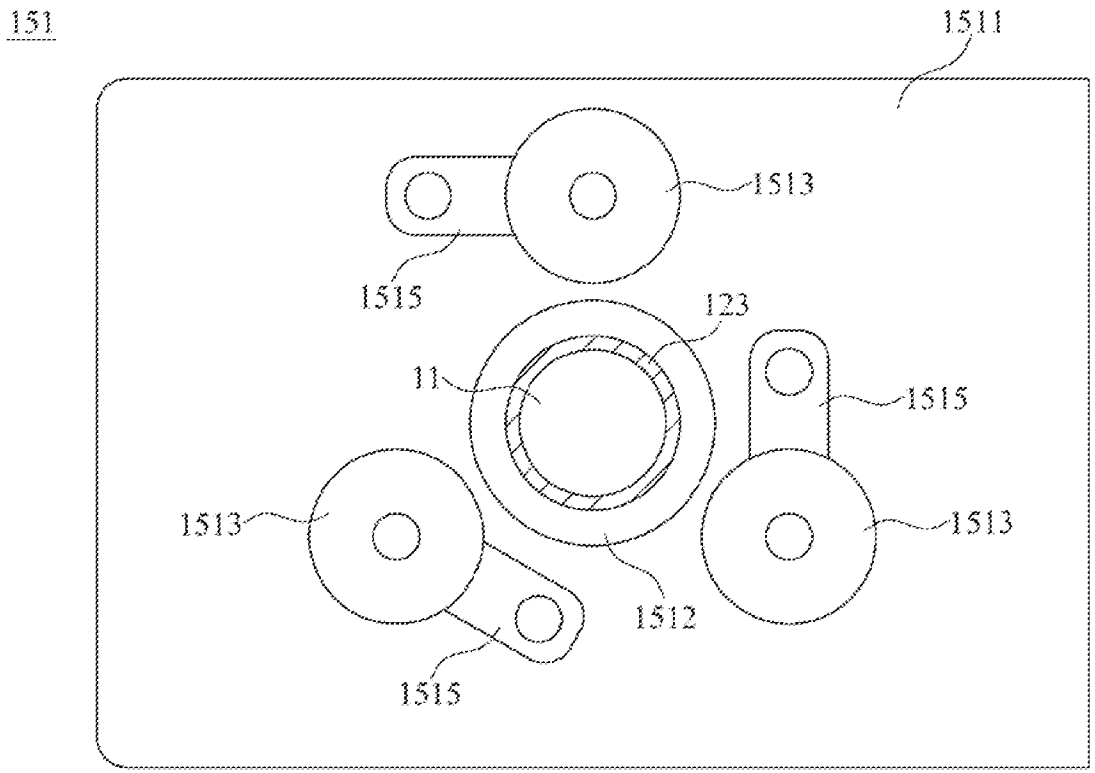
FIG. 3 is a schematic view showing a cutter of the paper tube making apparatus according to an embodiment of the present invention.

The paper tube making apparatus 10 may comprise a cutter 151, and the cutter 151 is arranged adjacent to the fixed rod 11 and is operable to cut the paper tube 123 formed on the fixed rod 11 into fixed-length pieces of the paper tube 123. In an embodiment of the present invention, as shown in FIG. 3, the cutter 151 comprises a base plate 1511, a plurality of rolling cutters 1513, and a plurality of swing arms 1515. Each of the rolling cutters 1513 is connected by a corresponding one of the swing arms 1515 to the base plate 1511. In an example, the number of the rolling cutters 1513 is three.

The base plate 1511 is formed with a through hole 1512, so that the fixed rod 11 and/or the paper tube 123 are extended through the through hole 1512 of the base plate 1511. The rolling cutters 1513 are arranged on a circumference around the through hole 1512, so as to be set in a circumferentially distributed manner. The swing arms 1515 are operable to drive the rolling cutters 1513 to swing or rotate relative to the base plate 1511, such that the rolling cutters 1513 are moved relative to the through hole 1512 of the base plate 1511 and the fixed rod 11 and/or the paper tube 123. For example, a motor can be used to drive the swing arms 1515 to rotate or swing or oscillate. In cutting the paper tube 123, the swing arms 1515 are operated to drive the rolling cutters 1513 to move toward the fixed rod 11 and the paper tube 123 in order to cut the paper tube 123 formed on the fixed rod 11. The above-described specifics or details of the structure of the cutter 151 are provided to illustrate one embodiment of the present invention and are not intended to impose undue constraint to the scope of protection that the present invention seeks for.

The cutter 151 is connected to a drive mechanism 153, and the drive mechanism 153 is operable to drive the cutter 151 to move along the fixed rod 11. In an example, the drive mechanism 153 comprises a stepping motor. Specifically, the moving speed of the cutter 151 is set identical or close to a generation speed of the paper tube 123, in order to prevent the paper tube 123 from pushing side surfaces of the cutter 152 during the paper tube 123 being cut off by the cutter 151.

Further, before the paper tape 121 is wound by the paper tape winding mechanism 13 to form the paper tube 123, glue must be applied and coated on the paper tape 121, such that the glue bonds portions of the paper tape 121 in an overlapping zone to form the paper tube 123. In an embodiment of the present invention, a glue applying device 19 is arranged an upstream of the fixed rod 11 and the paper tape winding mechanism 13, and the glue applying device 19 is operable to apply and coat the glue on a portion or the entirety of a surface of the paper tape 121.

Figure 4:
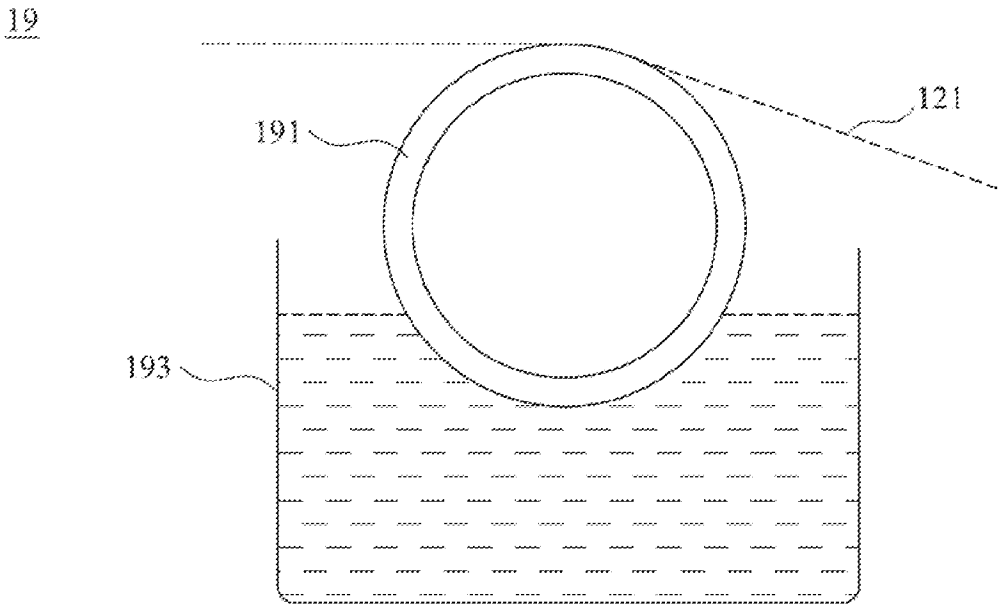
FIG. 4 is a schematic view showing a glue applying device of the paper tube making apparatus according to an embodiment of the present invention.

In an embodiment of the present invention, as shown in FIG. 4, the glue applying device 19 comprises a glue applying roller 191 and a glue tank 193. The glue tank 193 contains and holds the glue therein. The glue applying roller 191 is arranged to contact the glue held in the glue tank 193, such that when the glue applying roller 191 rotates, the glue is attached to and spread on a surface of the glue applying roller 191. During a process of conveyance or feeding, the paper tape 121 contacts the surface of the glue applying roller 191 so that the glue applying roller 191 applies and coats the glue on a surface of the paper tape 121.

To allow the glue to coat on the paper tape 121 in a uniform manner, at least one doctor blade may be used to scrape off extra glue from the surface of the glue applying roller 19. For example, the doctor blade is set in contact with the surface of the glue applying roller 191, such that when the glue applying roller 191 is rotating relative to the doctor blade, the doctor blade scrapes the extra glue from the surface of the glue applying roller 191, making the amount of glue on the surface of the glue applying roller 191 fixed and ensuring the glue applying roller 191 may continuously coat a fixed amount of glue on the paper tape 121.

Although proper operation of the glue applying device 19 helps keep the amount of glue coated on the paper tape 121 constant or consistent, the drying speed or drying rate of the glue is affected by the environment temperature and humidity, and this in turn affects the quality of the paper tube 123 so manufactured. Specifically, before the paper tape 121 is would around the paper tube 123, the glue coated on the paper tape 121 must be first dried to a certain extent, such as being partially dried, in order to adhesively bond the paper tape 121 in such a way as to enhance and stabilize the quality of the paper tube 123.

In case that the glue coated on the paper tape 121 is in a condition of being excessively wet, during the process of bonding, the glue often overflows the paper tape 121 and remains on a surface of the paper tube 123 to subsequently attach on and adhere to other mechanisms. For example, when the cutter 151 is cutting off the paper tube 123, the glue that remains on the paper tube 123 may adhere to the cutter 151. Further, during the cutter 151 is cutting off the paper tube 123, the glue, if not completely or properly dried, may cause the paper tube 123 to decompose and disintegrate, so as to affect the generated quality of the paper tube 123. Oppositely, glue that is excessively dried on the paper tape 121 would incapable of bonding the paper tape 121 to form the paper tube 123, and a similar condition of decomposition or disintegration may happen when the paper tube 123 is cut by the cutter 151.

Specifically, when the environment temperature is relatively high while the humidity is relatively low, the rate at which the glue coated on the paper tape 121 is being dried is fast. Oppositely, when the environment temperature is relatively low while the humidity is relatively high, the rate at which the glue coated on the paper tape 121 is being dried is slow. Due to such a reason, the prior art commonly modifies the formulation of the glue according to the environment temperature and humidity. For example, when the environment temperature is relatively high while the humidity is relatively low, the ratio of water contained in the glue is increased, and when the environment temperature is relatively low while the humidity is relatively high, the ratio of water contained in the glue is decreased.

In practical applications, there is no way to establish a quantified relationship between the environment temperature and humidity and the formulation of glue, and it generally relies on the experience of an operator to adjust and modify the formula of the glue. Such an operation of adjusting and modifying the formula of the glue needs a certain period of time for testing and adjusting and this would inevitably affect the efficacy and quality of production of the paper tube 123.

Further, the speed at which the paper tape 121 is conveyed or forwarded may also affect the extent of drying of the glue. For example, when the paper tape 121 is conveyed or forwarded at a fast speed, the glue would be in a relatively wet condition when the paper tape 121 reaches the paper tape winding mechanism 13, and when the paper tape 121 is conveyed or forwarded at a slow speed, the glue would be in a relatively dry condition when the paper tape 121 reaches the paper tape winding mechanism 13. Due to such a reason, the prior art makes adjustment on a distance between the glue applying device 19 and the paper tape winding mechanism 13 according to the conveying speed of the paper tape 121, such that when the paper tape 121 reaches the paper tape winding mechanism 13, the glue has achieved a desired extent of dry. This certainly adds difficulty to the use thereof and lowers down the production speed of the paper tube 123.

To avoids the above-described problems, the present invention further includes the hot airflow generation unit 14 and the length measurement unit 17 that are arranged an upstream of the fixed rod 11 and the paper tape winding mechanism 13. For example, the length measurement unit 17 is arranged the upstream of the glue applying device 19 to measure a conveyed length and/or a conveying speed of the paper tape 121. The hot airflow generation unit 14 is arranged between the glue applying device 19 and the paper tape winding mechanism 13 to generate and supply a hot airflow. Preferably, the flow rate and temperature of the hot airflow generated by the hot airflow generation unit 14 is adjustable.

In an embodiment of the present invention, at least one transportation roller 171 is arranged the upstream of the fixed rod 11 and the paper tape winding mechanism 13 and the transportation roller 171 functions to convey and supply the paper tape 121 onto the fixed rod 11 and the paper tape winding mechanism 13. The length measurement unit 17 is connected to one such transportation roller 171 to count the turns of rotation of the transportation roller 171 so as to calculate the conveyed length and/or the conveying speed of the paper tape 121.

In an embodiment of the present invention, the hot airflow generation unit 14 is in electrical connection with the length measurement unit 17 to adjust the flow rate and/or temperature of the hot airflow generated by the hot airflow generation unit 14 according to the conveyed length and/or conveying speed of the paper tape 121 measured by the length measurement unit 17.

By directing the hot airflow generated by the hot airflow generation unit 14 toward the glue coated on the paper tape 121, the extent of drying of the glue can be controlled and the influence of the environment temperature or humidity on the extent of drying of the glue can be reduced, so that there is no need to do modification or change of the formulation of the glue according to the environment temperature and humidity.

Specifically, during fabrication of the paper tube 123 using the paper tube making apparatus 10 according to the present invention, one major factor that affects the extent of drying of the glue is the conveying speed of the paper tape 121. When the conveying speed of the paper tape 121 is fast, the time period within which the glue coated on the paper tape 121 is being in contact with the hot airflow is short, so that the glue coated on the paper tape 121 that has passed the hot airflow generation unit 14 is relatively wet. Oppositely, when the conveying speed of the paper tape 121 is slow, the time period within which the glue coated on the paper tape 121 is being in contact with the hot airflow is increased, so that the glue coated on the paper tape 121 that has passed the hot airflow generation unit 14 becomes relatively dry.

For such a reason, the present invention further proposes adjusting the flow rate and temperature of the hot airflow generated by the hot airflow generation unit 14 according to the conveying speed and/or the conveyed length of the paper tape 121, so that when the paper tape 121 is going to wind to form the paper tube 123, the glue coated on the paper tape 121 may have consistent or fixed extent of drying to thereby prevent the glue coated on the paper tape 121 from becoming excessively dried or excessively wet and thus effectively enhance the quality of the paper tube 123 so fabricated.

Specifically, when the conveying speed of the paper tape 121 is fast, the temperature and flow rate of the hot airflow generated by the hot airflow generation unit 14 may be increased. Oppositely, when the conveying speed of the paper tape 121 is slow, the temperature and flow rate of the hot airflow generated by the hot airflow generation unit 14 may be reduced. By means of the above-described way of adjustment, the extent of drying of the glue coated on the paper tape 121 can be kept consistent at the time when the paper tape 121 is being wound to form the paper tube 123.

In a further embodiment of the present invention, the adjustment of the temperature and flow rate of the hot airflow generated by the hot airflow generation unit 14 can be made according to factor including the material, width, and thickness of the paper tape 121, the type and formula of the glue, and/or the thickness of coating.

In practical applications, the paper tube making apparatus 10 may comprise a calculation unit 18. In an example, the calculation unit 18 is or comprises a computer. The calculation unit 18 is in electrical connection with the length measurement unit 17 and the hot airflow generation unit 14, and receives data of the conveyed length of the paper tape 121 from the length measurement unit 17 in order to calculate the conveying speed of the paper tape 121, and to control the flow rate and temperature of the hot airflow generated by the hot airflow generation unit 14 according to the conveying speed of the paper tape 121.

The above description is made only to provide an illustration of a preferred embodiment of the present invention and is not intended to limit the scope of embodiment of the present invention. Equivalent variation and modification in respect of shape, structure, feature, and spirit that fall within the appended claims with which the present invention is solely defined are considered within the scope of the present invention as defined in the claims.

What is claimed is:

1. A paper tube making apparatus, comprising:

a fixed rod;

a paper tape winding mechanism arranged adjacent to the fixed rod, wherein the fixed rod and the paper tape winding mechanism receive a paper tape and then the paper tape winding mechanism is operable to wind the paper tape around the fixed rod to form a paper tube;

a cutter arranged adjacent to the fixed rod and operable to cut the paper tube formed on the fixed rod, said cutter being configured with a base plate fabricated with a through hole for passing said paper tube formed on said fixed rod therethrough, a plurality of swing arms, each swing arm having a first and second ends, said each swinging arm being attached, at said first end thereof, to said base plate, and a plurality of rolling cutters, each rolling cutter being attached to said second end of a corresponding swing arm of said plurality thereof, wherein said plurality of rolling cutters are disposed on said base plate in a circumferential fashion around said through hole, wherein said plurality of swing arms are controlled to drive said plurality of rolling cutters towards said paper tube for engagement therewith and cutting said paper tube with said plurality of rolling cutters;

a drive mechanism coupled to the cutter and operable to drive the cutter to move along the fixed rod, said driver mechanism controlling a moving speed of said cutter in correspondence with a speed of said paper tube fabrication;

a glue applying device arranged upstream of the fixed rod and the paper tape winding mechanism and is operable to coat a glue on a surface of the paper tape;

a length measurement unit arranged upstream of the fixed rod and the paper tape winding mechanism, said length measurement unit is configured to measure a conveying speed of the paper tape and to output data corresponding to the conveying speed of the paper tape;

a hot airflow generation unit arranged between the glue applying device and the paper tape winding mechanism to generate a hot airflow toward the glue coated on the paper tape; and a calculation unit operatively coupled in electrical connection with the length measurement unit and the hot airflow generation unit, said calculation unit being configured to receive, from said length measurement unit, said data corresponding to the conveying speed of the paper tape and to control a flow rate and a temperature of the hot airflow generated by the hot airflow generation unit by adjusting the flow rate and the temperature of the hot airflow in accordance with said data corresponding to the conveying speed of the paper tape.

2. The paper tube making apparatus according to claim 1, wherein the paper tape winding mechanism comprises a supporting base, a driving roller, at least one pulley, and a belt, the driving roller and the pulley being mounted on the supporting base, the belt being wound around the driving roller, the pulley, and the fixed rod, wherein the paper tape is located between the belt and the fixed rod, such that the driving roller, when rotating, drives the belt to wind the paper tape around the fixed rod to form the paper tube.

3. The paper tube making apparatus according to claim 1, further comprising at least one transportation roller arranged upstream of the fixed rod and the paper tape winding mechanism to convey the paper tape to the fixed rod and the paper tape winding mechanism, the length measurement unit being connected to the transportation roller and being operable to count turns of rotation of the transportation roller in order to determine the conveying speed of the paper tape.

4. The paper tube making apparatus according to claim 1, wherein said calculation unit is further configured to calculate the conveying speed of the paper tape according to a conveyed length of the paper tape measured by the length measurement unit.

5. The paper tube making apparatus according to claim 1, wherein the length measurement unit is arranged upstream of the glue applying device.

6. The paper tube making apparatus according to claim 1, wherein the glue applying device comprises a glue applying roller and a glue tank, the glue tank receiving and holding the glue, the glue applying roller being arranged in contact with the glue received and held in the glue tank and being operable to coat the glue on the paper tape in contact therewith.

* * * * *